United States Patent [19]

Huang et al.

[11] Patent Number: 4,606,888

[45] **Date of Patent: * Aug. 19, 1986**

[54] INHIBITION OF GRAIN GROWTH IN $NI_3AL$ BASE ALLOYS

[75] Inventors: Shyh-Chin Huang, Latham; Keh-Minn Chang; Alan I. Taub, both of Schenectady, all of N.Y.

[73] Assignee: General Electric Company, Schenectady, N.Y.

[ * ] Notice: The portion of the term of this patent subsequent to Oct. 23, 2001 has been disclaimed.

[21] Appl. No.: 646,879

[22] Filed: Sep. 4, 1984

[51] Int. Cl.[4] ..... C22C 19/03

[52] U.S. Cl. ..... 420/459; 148/429; 420/460

[58] Field of Search ..... 420/460, 459; 148/429

[56] References Cited

U.S. PATENT DOCUMENTS 4,478,791 10/1984 Huang et al. ..... 148/429

*Primary Examiner*—R. Dean

*Attorney, Agent, or Firm*—Paul E. Rochford; James C. Davis, Jr.; James Magee, Jr.

[57] ABSTRACT

Inhibition of grain size growth in a tri-nickel aluminide is achieved by additions of minor amounts of a metal selected from the group comprising rhenium and molybdenum.

17 Claims, No Drawings

INHIBITION OF GRAIN GROWTH IN $NI_3AL$ BASE ALLOYS

BACKGROUND OF THE INVENTION

The present invention relates generally to compositions having a nickel aluminide base and which are suitable for consolidation into useful articles. More particularly, it concerns a rapidly solidified tri-nickel aluminide having an additive which inhibits the grain growth of the aluminide and thereby benefits the control of the properties of the aluminide.

It is known that polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, polycrystalline material which is conventionally formed by known processes does not display the desirable properties of the single crystal material and although potentially useful as a high temperature structural material, has not found extensive use in this application because of poor properties exhibited by the material at room temperature.

For example, it is known that nickel aluminide has good physical properties at temperatures above 1000° F. and could be employed, for example, in jet engines as component parts at operating or higher temperatures. However, if the material does not have favorable properties at room temperature and below the part formed of the aluminide may break when subjected to stress at the lower temperatures at which the part would be maintained prior to starting the engine and prior to operating the engine at the higher temperatures. Alloys having the tri-nickel aluminide base are among the group of alloys known as heat-resisting alloys or superalloys. These alloys are intended for very high temperature service where relatively high stresses (tensile, thermal, vibratory and shock) are encountered and where oxidation resistance is frequently required. Accordingly, what has been sought in the field of superalloys is an alloy composition which displays favorable stress resistant properties not only at the elevated temperatures at which it may be used, as for example in a jet engine, but also a practical and desirable and useful set of properties at the lower temperatures to which the engine is subjected in storage and mounting and in starting operations. For example, it is well known that an engine may be subjected to severe subfreezing temperatures while standing on a field or runway prior to starting the engine. Stresses imparted to a part of the engine at these temperatures require that the part have desirable stress resistant properties at such lower temperatures.

Significant efforts have been made toward producing a tri-nickel aluminide and similar superalloys which may be useful over a wide range of temperatures and which may be adapted to withstand the stress to which articles made from the material may be subjected in normal operation over such a wide range of temperatures. For example, copending application Ser. No. 444,932, filed Nov. 29, 1982, now U.S. Pat. No. 4,478,791, assigned to the same assignee as the subject application teaches a method by which a significant measure of ductility can be imparted to a tri-nickel aluminide base metal at room temperature to overcome the brittleness which is otherwise found in these materials. This application is incorporated herein by reference. It teaches including 0.01 to 2.5 at. % boron to improve the combination of ductility and strength. It teaches that a preferred range of boron is from 0.05 to 2.5 at. % boron.

Also, copending application of the same inventors of the subject application, Ser. No. 647,328, filed Sept. 4, 1984 teaches a method by which the composition and method of U.S. Pat. No. 4,478,791 may be improved. This application is incorporated herein by reference.

One of the properties which affects physical properties of a superalloy is the grain size of the individual crystals and grains of the alloy. It is a distinct advantage in the preparation of a superalloy such as a tri-nickel aluminide to be able to control the size of the grains formed as well as their growth during heat treatment and later use. Grains grow by moving their boundaries outward. Outward movement is inhibited when a second phase is encountered.

In general, small grains result in higher strength at lower temperatures. It is well known that the strength of a material is increased with decreasing size of the grains of the material. However, materials with fine grains have poorer properties at elevated temperatures. This is illustrated by a lower resistance to creep for fine grain materials at elevated temperatures. To obtain a desired combination of properties which relate to grain size, it is important to be able to control the grain growth of a material.

In general, application of heat to a material induces grain growth. The presence of second phase particles inhibits such growth of grains. To induce grain growth in a material having second phase particles higher temperature heating or longer heating or a combination of higher temperature and longer heating periods is required. Where a second phase is present, control of growth of grain size is enhanced. Where no second phase particles are present, the attainment of a certain grain size is difficult, particularly if the desired grain size is small, as for example of the order of 100 $\mu m$ or less.

It is known that second phase particles impede grain boundary motion and thus benefit control of grain size. The presence of such second phase particles is particularly desirable in materials which require thermal mechanical processing. For example, in the $Ni_3Al$-B-base alloys $M_{23}B_6$ particles are found in some compositions. However, these particles tend to coarsen severely at elevated temperatures giving rise to grain boundary failures. Accordingly, not all particles which are formed at grain boundaries are beneficial to the control of the grain size and the particles which coarsen at elevated temperatures during such thermomechanical processing can lead to grain boundary failures.

Generally, second phase particles which do not coarsen and do not form platelets, and which have strong adhesion to the first phase, are beneficial to achieving a designated balance of material properties.

Accordingly it is desirable to provide second phase particles which do not coarsen so severely at elevated temperatures and which can accordingly control the grain size of the $Ni_3Al$ composition while still retaining large ductility imparted by the boron addition.

BRIEF SUMMARY OF THE INVENTION

It is accordingly one object of the present invention to provide a method for forming an aluminide article having fine grains and adapted to use in structural parts over a broad range of temperatures.

Another object is to provide an aluminide article having fine grains suitable for withstanding significant degrees of stress and for providing and retaining appreciable ductility over such a broad range of temperatures.

Another object is to provide such an aluminide article which has a controlled grain size.

Another object is to provide a method of controlling the grain size of a nickel aluminide adapted for use over a broad range of temperatures.

Another object is to provide an additive which results in a composition which has a controlled grain size when rapidly solidified.

Other objects will be in part apparent and in part pointed out in the description which follows.

In one of its broader aspects, objects of the invention may be achieved by providing a melt of a nickel aluminide composition containing a relatively small percentage of a metal selected from the group consisting of molybdenum and rhenium in addition to the boron additives. Such a composition is rapidly solidified and may then be consolidated into a useful article by annealing under pressure at about 1100° C. for a period of hours. Control of grain growth due to the presence of a small quantity of molybdenum or rhenium is achieved.

DETAILED DESCRIPTION OF THE INVENTION

In a recent publication, investigators at the Imperial College of Science and Technology, London, reported a study of nickel, aluminum, and molybdenum compositions. See the April issue of Metal Science, 1981, Volume 17, starting at page 192. In this paper, they pointed out that a ternary composition of $Ni_3Al$ can contain up to 6 at. % molybdenum without formation of second phase material. The article does not disclose boron as an ingredient of the compositions investigated and the article contains no reference to or discussion of the possible effects of boron as an ingredient.

EXAMPLE 1

A composition containing a nickel aluminide base was prepared as a melt. The composition had the following ingredients in atomic percent (at. %):

$$(Ni_{0.76}Al_{0.23}Re_{0.01})_{89.75}Fe_{10}B_{0.25}.$$

The composition was then remelted and was processed to form a rapidly solidified ribbon in vacuum. The cooling rate for the rapid solidification was about $10^5$° C. per second. The ribbon was then annealed at 1100° C. for 2 hours. This is the time and temperature of annealing which would be employed in consolidating ribbon into a consolidated article although the consolidation was not carried out for this example. The ribbon microstructure was then studied by metallography and the mechanical properties were studied by tensile tests at room temperature.

The metallographic study showed that the annealed ribbon contained the desirable $Ni_3Al$ as the matrix or primary phase as well as particles of second phase. The particles of the alloy were about 0.5 μm in size and spherical in shape. They were probably a solid solution phase rich in rhenium or a boride phase containing rhenium. They appeared to have retarded the grain growth of the grains of the rapidly solidified and annealed ribbon. The grain size observed was of the order of 10 μm. Other experience with such compositions has shown that without the second phase particles, the grains would have grown to approximately the ribbon thickness of about 30 μm.

A tensile test was performed and the results are as follows:

TABLE I

| Alloy | Yield Strength (ksi) | Tensile Strength (ksi) | Fracture Strain (%) |
|---|---|---|---|
| Example 1 | 68 | 148 | 20.6 |

The observed ductility (fracture strain %) was better than that of the single phase alloy $(Ni_{0.76}Al_{0.24})_{89}Fe_{10}B_1$ which is described in copending application Ser. No. 647,328 and disclosed therein as having a fracture strain of 14% elongation.

EXAMPLE 2

A melt was prepared to contain the following composition:

$$(Ni_{0.76}Al_{0.22}Mo_{0.02})_{89.75}Fe_{10}B_{0.25}.$$

The alloy was remelted and rapidly solidified as ribbon by melt spinning into ribbon in vacuum. The cooling rate for the melt spinning was about $10^5$° C. per second. The material was annealed at 1100° C. for 2 hours as in Example 1. The microstructure of the ribbon was studied by metallography and the mechanical properties were studied by tensile tests at room temperature. The metallographic study showed that the annealed ribbon contained second phase particles. The second phase particles which appear to have retarded the grain growth, were about 1 μm in diameter, and were slightly faceted. They were probably a solid solution phase rich in molybdenum or a boride phase containing molybdenum. The grain growth was limited to about 20 μm as compared to the 30 μm which would otherwise be expected for such a ribbon as 30 μm is the size of the ribbon thickness. Accordingly, the second phase particles appear to have retarded the grain growth of the material of Example 2.

The tensile test performed resulted in the following findings given in Table II.

TABLE II

| Alloy | Yield Strength (ksi) | Tensile Strength (ksi) | Fracture Strain (%) |
|---|---|---|---|
| Example 2 | 49 | 129 | 19.8 |

The observed ductility was better than that of the single phase alloy $(Ni_{0.76}Al_{0.24})_{89}Fe_{10}B_1$ referred to above in connection with Table I.

In carrying out the present invention, the concentrations of the ingredients are subject to change within designated ranges.

The iron concentration can be altered to between 5 at. % and 20 at. % and the aluminide is correspondingly altered to between about 95 at. % and 80 at. %.

The boron concentration can be altered as set forth in copending application Ser. No. 444,932, U.S. Pat. No. 4,478,791. It can be varied from 0.01 to 2.5 at. % and is preferable altered between 0.05 and 2.5 at. %.

What is claimed is and sought to be protected by letters patent in the United States is as follows:

1. The method of inhibiting the grain growth of a rapidly solidified boron containing $Ni_3Al$ type composition which comprises incorporating in the composition a small quantity of a metal selected from the group consisting of rhenium and molybdenum.

2. The method of inhibiting grain growth of a composition comprising $$(Ni_{0.76}Al_{0.24-a}X_a)_{89.75}Fe_{10}B_{0.25}$$

which comprises adding to the composition a small quantity of material, X, selected from the group consisting of rhenium and molybdenum.

3. The method of claim 2 in which X is rhenium.

4. The method of claim 2 in which X is molybdenum.

5. The method of claim 2 in which the quantity of additive, a, is from 0.1 to 0.2.

6. The method of claim 5 in which X is rhenium.

7. The method of claim 5 in which X is molybdenum.

8. As a composition of matter, a fine grain alloy containing the following composition $$(Ni_{0.76}Al_{0.24-a}X_a)_{89.75}Fe_{10}B_{0.25}$$

wherein X is selected from the group consisting of Re and Mo.

9. The composition of claim 8 in which a is 0.01 to 0.02.

10. The composition of claim 8 in which x is rhenium.

11. The composition of claim 8 in which x is molybdenum.

12. As an article of manufacture a rapidly solidified boron-doped tri-nickel aluminde ribbon, said ribbon having incorporated therein a small quantity of metal selected from the group consisting of rhenium and molybdenum, said quantity being an amount effective to inhibit grain growth.

13. The article of claim 12 wherein the tri-nickel aluminide is $$(Ni_{0.76}Al_{0.24-a}x_a)_{89.75}Fe_{10}B_{0.25}.$$

14. The article of claim 13 wherein x is rhenium.

15. The article of claim 13 wherein x is molybdenum.

16. The article of claim 13 wherein a is from 0.1 to 0.2.

17. The article of claim 13 wherein x is rhenium and a is 0.2.

* * * * *